US009487950B2

(12) United States Patent
Sladojevic

(10) Patent No.: US 9,487,950 B2
(45) Date of Patent: Nov. 8, 2016

(54) FALSE FORMWORK FOR MOULDING CONCRETE PANELS

(71) Applicant: SRB Construction Technologies Pty. Ltd., Kent town, South Australia (AU)

(72) Inventor: Robert Sladojevic, Kent Town (AU)

(73) Assignee: SRB Construction Technologies Pty. Ltd., Kent Town (AU)

( * ) Notice: Subject to any disclaimer, the term of this patent is extended or adjusted under 35 U.S.C. 154(b) by 418 days.

(21) Appl. No.: 14/230,869

(22) Filed: Mar. 31, 2014

(65) Prior Publication Data

US 2014/0208685 A1 Jul. 31, 2014

Related U.S. Application Data

(62) Division of application No. 12/514,257, filed as application No. PCT/AU2007/001654 on Oct. 31, 2007, now abandoned.

(30) Foreign Application Priority Data

Nov. 14, 2006 (AU) ..... 2006-906335

(51) Int. Cl.

| | |
|---|---|
| ***B28B 23/00*** | (2006.01) |
| ***E04B 2/84*** | (2006.01) |
| ***B28B 7/00*** | (2006.01) |
| ***B28B 7/16*** | (2006.01) |
| ***E04G 15/02*** | (2006.01) |

(Continued)

(52) U.S. Cl.

CPC ..... *E04B 2/84* (2013.01); *B28B 7/0014* (2013.01); *B28B 7/0085* (2013.01); *B28B 7/0088* (2013.01); *B28B 7/164* (2013.01); *E04G 11/06* (2013.01); *E04G 15/02* (2013.01); *E04G 21/02* (2013.01); *E04G 2011/067* (2013.01)

(58) Field of Classification Search

CPC ..... E04B 2/84; B28B 7/164; E04G 15/02
USPC ..... 264/138, 154; 249/15, 39, 41, 52, 214
See application file for complete search history.

(56) References Cited

U.S. PATENT DOCUMENTS 2,684,518 A * 7/1954 Whitlock ..... E04G 15/00 249/52
2,728,126 A * 12/1955 Whitlock ..... B28B 23/00 249/52

(Continued)

FOREIGN PATENT DOCUMENTS

DE 199 02 172 A1 9/2000
EP 0 273 492 A2 7/1988

(Continued)

*Primary Examiner* — Timothy Kennedy
(74) *Attorney, Agent, or Firm* — Sughrue Mion, PLLC

(57) ABSTRACT

A false formwork system (40) includes a plurality of sideforms (17) which are able to be interconnected to define a perimeter of an opening in a panel to be cast. A support structure (24) is carried by the sideforms (17) for supporting components (26) used to mold a false skim coat overlying the opening when the panel is cast. An opening demarcation portion (21) is carried by each of at least some of the sideforms (17). Each opening demarcation portion (21) defines a zone of weakness to demarcate the skim coat of the cast panel from a remainder of the panel and to facilitate removal of the skim coat from the remainder of the panel by breakage along the zone of weakness.

7 Claims, 3 Drawing Sheets

(51) Int. Cl.
*E04G 11/06* (2006.01)
*E04G 21/02* (2006.01)

(56) References Cited

U.S. PATENT DOCUMENTS

| | | | |
|---|---|---|---|
| 5,069,849 | A | 12/1991 | Wain |
| 5,671,571 | A | 9/1997 | Braun |
| 6,122,883 | A | 9/2000 | Braun |
| 6,427,398 | B1 | 8/2002 | Levine et al. |
| 6,574,936 | B1 | 6/2003 | Anderson, Sr. |
| 7,263,808 | B2 | 9/2007 | Massey et al. |
| 7,530,544 | B2 | 5/2009 | Takagi |
| 7,621,079 | B2 | 11/2009 | Takagi et al. |
| 2003/0141624 | A1 | 7/2003 | Takagi et al. |
| 2005/0034388 | A1 | 2/2005 | Bealko |
| 2005/0061948 | A1 | 3/2005 | Brennan |
| 2006/0218870 | A1 | 10/2006 | Messenger et al. |

FOREIGN PATENT DOCUMENTS

| | | | |
|---|---|---|---|
| JP | 01-215507 | A | 8/1989 |
| WO | 01/44600 | A1 | 6/2001 |
| WO | 2005/116365 | A1 | 12/2005 |
| WO | 2007/043897 | A2 | 4/2007 |
| WO | 2008/046177 | A1 | 4/2008 |

* cited by examiner

FALSE FORMWORK FOR MOULDING CONCRETE PANELS

CROSS-REFERENCE TO RELATED APPLICATIONS

This application is a divisional of U.S. patent application Ser. No. 12/514,257, filed on May 8, 2009, which is a National Stage of International Application No. PCT/AU2007/001654, filed on Oct. 31, 2007, which claims priority from Australian Patent Application No. 2006-906335, filed on Nov. 14, 2006, the contents of all of which are incorporated herein by reference in their entirety.

FIELD OF THE INVENTION

This invention relates to formwork for use in the construction of concrete panels, in particular tilt-up wall panels, where the panels are cast in a stack one on top of the other. More specifically, the invention relates to false formwork for producing tilt-up concrete wall panels in which window or door openings are formed and to a method of casting a concrete panel.

BACKGROUND TO THE INVENTION

In traditional formwork methods in the moulding of a concrete wall panel, in situations where a window or door opening is required to be formed in the panel, it is common practice for false formwork, normally constructed of timber, to be installed within the panel mould so that the false formwork defines the opening to be formed. The false timber formwork is nailed together and plastic fillet forming strips are attached to the timber formwork around parts of the formwork defining upper and lower perimetral parts of the opening. With the false formwork in place, the void or cavity defined by the false formwork is filled with either dirt/rubble or polystyrene foam, following which the concrete is poured into the mould to form the panel.

Such a procedure would not be suitable for casting concrete panels which are to have window/door openings formed therein, one on top of the other, mainly due to formwork imprints being left on the cast face of the upper panel. This necessitates carrying out rectification work following erection of the wall panel. Another disadvantage with known timber false formwork is that all of its components become waste product due to the fact that they cannot be re-used for moulding another concrete panel. Still further the installation of the timber false formwork must generally be carried out by a skilled person, e.g. a carpenter, which adds to the overall cost of moulding the panels.

SUMMARY OF THE INVENTION

According to a first aspect of the invention, there is provided a false formwork system which includes a plurality of sideforms which are able to be interconnected to define a perimeter of an opening in a panel to be cast;

a support structure carried by the sideforms for supporting components used to mould a false skim coat overlying the opening when the panel is cast; and an opening demarcation portion carried by each of at least some of the sideforms, each opening demarcation portion defining a zone of weakness to demarcate the skim coat of the cast panel from a remainder of the panel and to facilitate removal of the skim coat from the remainder of the panel by breakage along the zone of weakness.

Each sideform may be connected to an adjoining sideform by a corner form. Thus, each sideform may have a receiving formation in which a mating formation of the corner form is receivable.

Each sideform may be an angle section having a foot portion and an element extending substantially orthogonally from the element, the element defining the opening demarcation portion. The foot portion may be of sufficient length to support the panel to be cast on an underlying structure, such as a cast panel or bed, in a load distributing manner. Each foot portion may be secured, in use, to the underlying structure by an adhesive material such as double-sided tape. Instead, each foot portion may be secured to the underlying structure by fasteners such as, for example, bolts, screws, nails, or the like.

The opening demarcation portion of each sideform may be a bevel surface defining portion projecting at an angle from the element in a direction away from the foot portion of the element to form a bevel on one perimetral edge of the opening in the panel. Desirably the free edge of the opening demarcation portion on each of the sideforms members terminates approximately 2 mm below the finished upper surface of the panel to be cast, while the thickness of the skim coat is in the order of 30 mm.

The support structure of each sideform may be a ledge arranged on the element intermediate the opening demarcation portion and the foot portion, the ledge extending substantially parallel to, and in the same direction as, the foot portion.

Each sideform may include an attachment formation for attaching a bevel surface defining member of an elastomeric material for imparting a bevel to an opposed perimetral edge of the opening in the panel.

Preferably, the system includes the bevel surface defining member for each sideform, each member being removably attachable to its associated sideform to enable the member to be removed from its sideform to facilitate removal of the sideform from the opening in the panel.

The system may include an intermediate support member for supporting the components to form the false skim coat, the intermediate support member being of a dimension to support the components at a position less than a thickness of the panel to be cast. The intermediate support member may be a support frame. The components may be sheets of plywood.

The sideforms and/or the corner forms may be of a plastics material or an aluminium material.

According to a second aspect of the invention, there is provided a method of casting a concrete panel, the method including erecting a plurality of sideforms on a base to define an outer periphery of a panel to be cast;

erecting false formwork within the sideforms to define an opening in the panel to be cast;

demarcating at least a portion of a periphery of the opening;

mounting infill in the false formwork so that the infill lies at a level lower than a surface of the panel to be cast;

pouring concrete into the sideforms so that the concrete overlies the infill to define a false skim coat over the opening; and allowing the concrete to set to provide an uninterrupted upper surface of the panel.

The method may include demarcating the at least portion of the periphery of the opening by forming a line of weakness in the cast concrete from below the upper surface of the panel.

The method may include casting a further panel on the panel previously cast in substantially the same manner as the panel previously cast and using the previously cast panel as the base for the further panel to be cast, the uninterrupted upper surface of the panel previously cast facilitating a lack of an imprint in a lower surface of the further panel.

Further, the method may include, once the concrete has been finished and allowed to set, removing the sideforms, raising the panel and removing the infill. After removal of the infill, the method may include breaking away the false skim coat along the demarcated periphery of the opening.

The method may include removing the false formwork for re-use.

BRIEF DESCRIPTION OF THE DRAWINGS

An embodiment of the invention is now described by way of example with reference to the accompanying drawings in which.

DETAILED DESCRIPTION OF EXEMPLARY EMBODIMENTS

Figure 1:
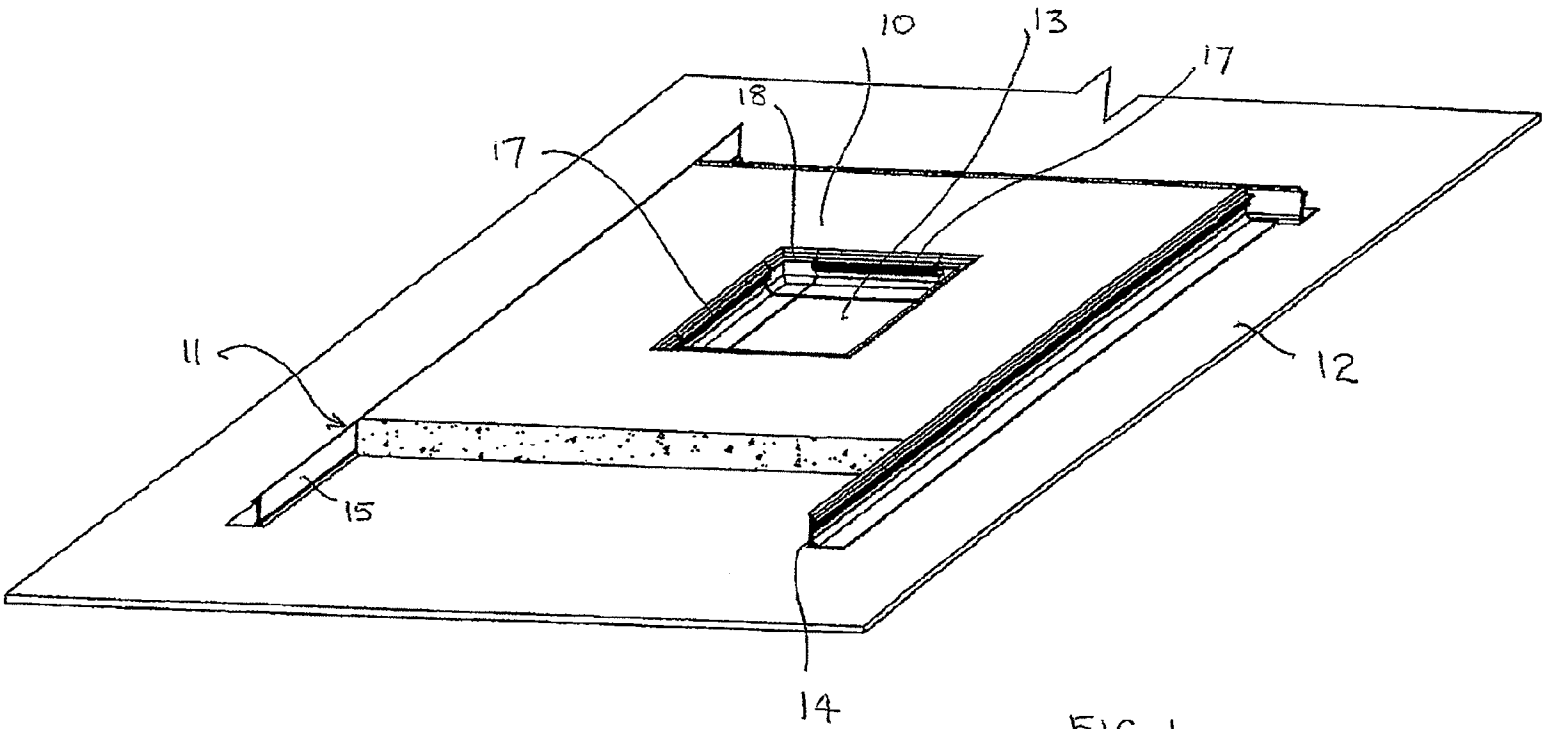
FIG. 1 is a fragmentary, partly sectioned, perspective view of a panel casting system for moulding a concrete panel on a base and which has a window opening formed therein using an embodiment of a false formwork system.

Referring initially to FIG. 1 of the drawings, reference numeral 10 generally designates a cast concrete panel. The panel 10 is formed by pouring concrete into a mould formed by a plurality of interconnected orthogonally arranged main sideforms 11 which are affixed by any suitable means to a base or bed 12. The bed 12 could be a base concrete panel in situations where concrete panels are cast one on top of the other.

A square or rectangular window opening is formed in the cast panel 10 using an embodiment of a false formwork system 40 of the invention. It will be appreciated that the false formwork system 40 of the invention could also be used for forming a door opening in the panel 10.

Each of the sideforms 11 is formed from an aluminium extrusion of angle section. A vertical flange 14 of the sideform 11 has fillets extending along the top and bottom edges of a face 15 of the vertical flange 14 of the sideform 11, so as to provide bevelled edge surfaces extending around upper and lower perimeters of the cast panel 10. In this specification, where reference is made to a direction such as "upper" or "lower", it is with reference to the panel being in its position in which it is cast, i.e. lying horizontally.

Figure 2:
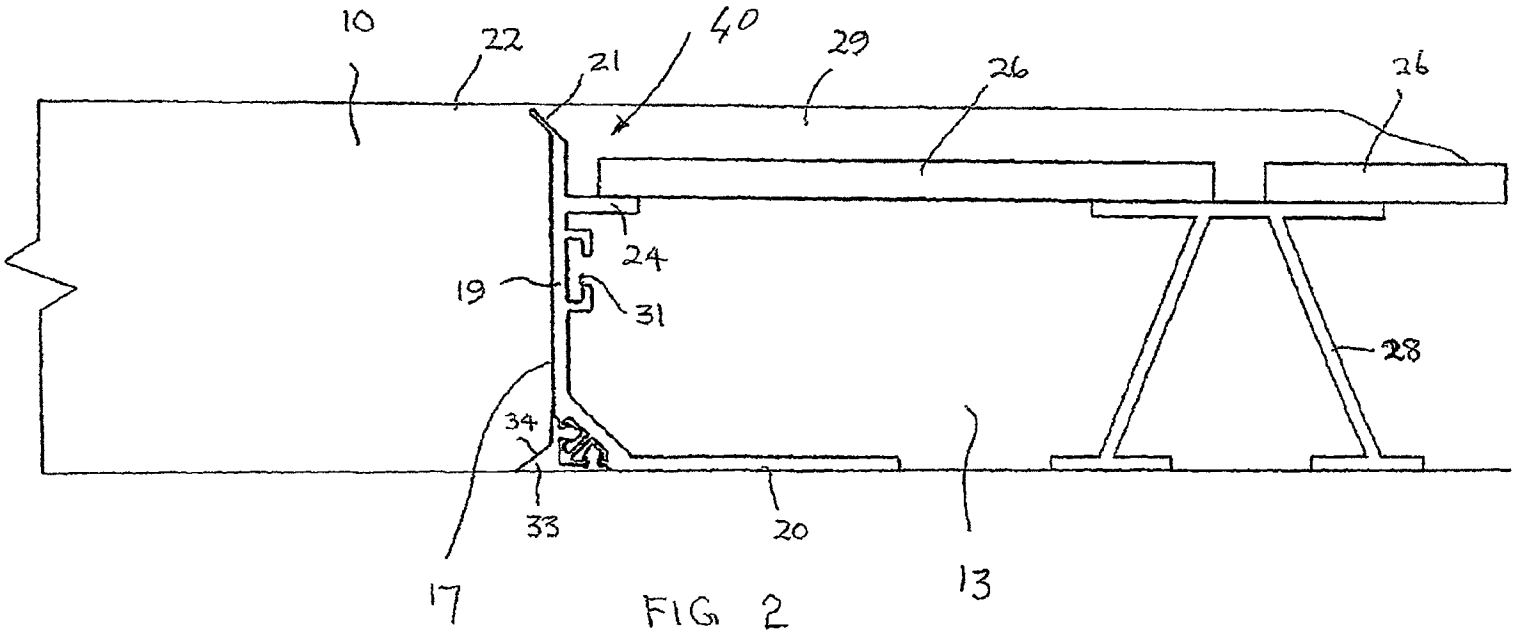
FIG. 2 is a fragmentary, part sectional view of a cast panel and the false formwork system which is used to form the window opening.
Figure 3:
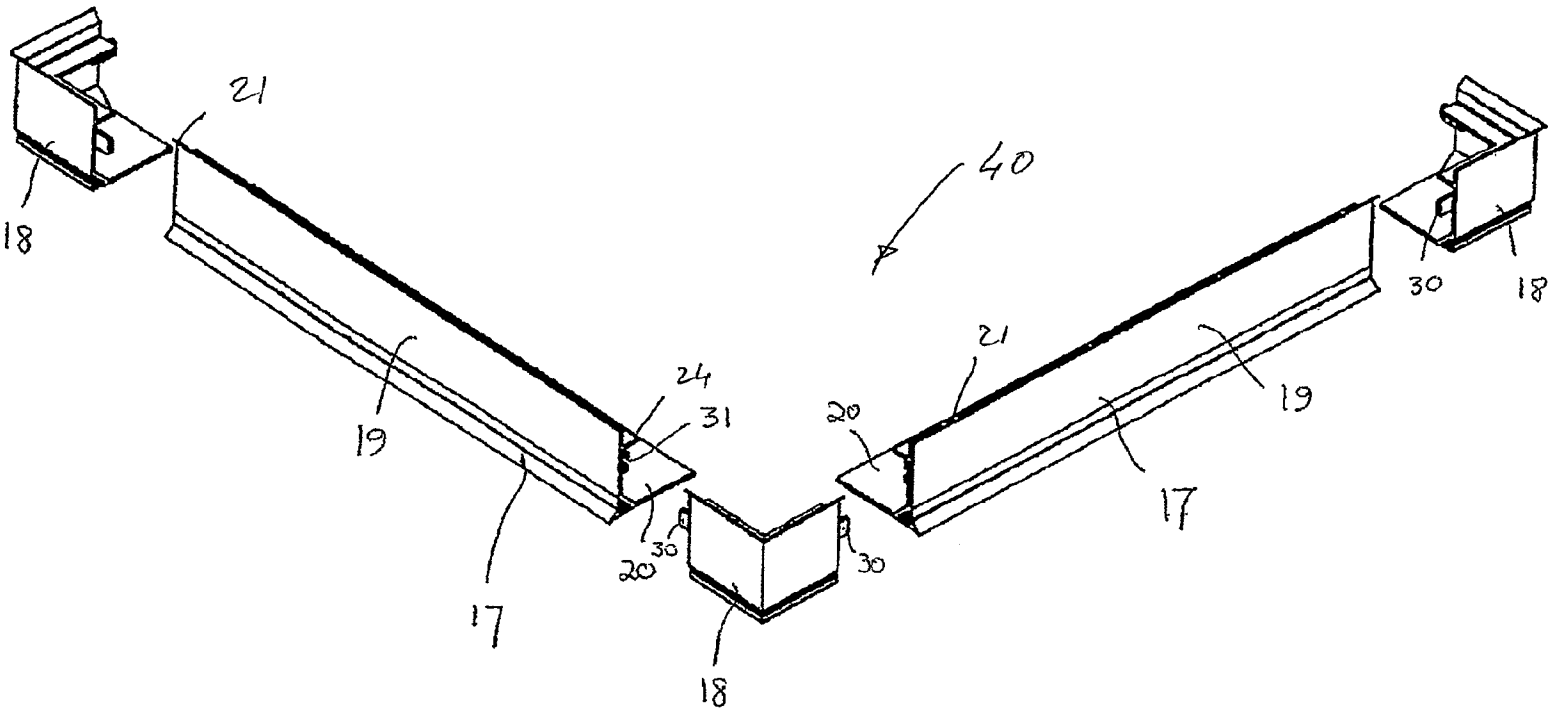
FIG. 3 is a fragmentary, exploded perspective view of part of the false formwork system used to form the opening in the cast panel.

As indicated above, the opening 13 is formed in the cast panel 10 by means of the false formwork system 40 in accordance with an embodiment of the invention. With reference to FIGS. 2 & 3 of the drawings, the false formwork system 40 is described in greater detail. The false formwork system 40 comprises a plurality of elongate sideforms 17 interconnected by corner forms 18, the sideforms 17 and the corner forms 18 together defining a perimeter of the opening 13.

In this embodiment, each sideform 17 is formed from a plastics extrusion of angle section having an operatively vertically extending element 19 and a laterally projecting foot portion, or foot, 20. The foot 20 is directly supported on the base 12, in use, and is affixed to the base 12 by means of an adhesive such as, for example, a doubled-sided adhesive tape (not shown) or fasteners such as bolts, screws, nails, or the like. The foot 20 is also of a sufficient length to distribute a load imparted to the bed or base 12.

The element 19 terminates at its operatively upper end in an opening demarcation portion in the form of an angled lip or flange 21 which extends from the element 19 in a direction away from the foot 20. A height dimension of the element 19 is such that an upper free edge of the flange 21 lies just below a top of a surface 22 (FIG. 2) of the cast panel 10. The flange 21 is used to form an upper perimetral edge of the opening 13.

An operatively inner surface of the element 19 is provided with a support structure in the form of an inwardly projecting ledge 24 which extends substantially parallel to, and in the same direction as, the foot 20 of the sideform 17. The ledge 24 is arranged below the flange 24. The ledges 24 of the sideforms 17 support one or more infill plywood sheets 26 (shown in FIG. 2). The infill sheets 26 occlude the opening 13 and form a recessed casting bed which is filled with concrete when the panel 10 is poured to form a false skim coat 29. Typically the casting bed is about 30 mm in height. In cases where two or more sheets 26 are used, an intermediate support member in the form of a central support frame 28 is used to support inner edges of the sheets 26.

The false skim concrete coat 29 is finished uniformly with the cast panel 10 to provide a uniform surface 22 to the panel 10 so that there will be no imprints or variants to the finish of a mating cast face of a further panel (not shown) which is cast on the surface 22 of the panel 10. For each cast panel 10, the false skim coat 29 can easily be broken away from the panel 10 due to the narrow break lines created by the upper edges of the flanges 21 terminating just below the surface 22 of the panel 10. Each break line generally will be in the order of 2 mm thick. With the skim coat 29 broken away, the upper perimetral edges of the opening 13 will only require a light stone to smooth them off.

A channel shaped keyway 31 is arranged on the element 19 below, and on the same side of the element 19 as, the ledge 24. As shown in FIG. 3 of the drawings, each corner piece form 18 is attached to adjoining sideforms 17 by means of projecting tongues 30 which slidably locate in the keyways 31 of the sideforms 17.

As is clearly shown in FIG. 2 of the drawings, each sideform 17 is provided with a detachable longitudinal insert 33 along its bottom edge at the junction of the element 19 and the foot 20. The insert 33 has a bevel surface 34 so as to form a bevel about the lower perimetral edge of the opening 13. In this embodiment, the insert 33 is formed from an elastomeric material such as a rubber extrusion.

The shape of the upper flange 21 as well as the bevel surface 34 on the insert 33 can be made to various shapes in order to provide a decorative edge finish for the edges of the window opening 13.

After casting of the panel 10, the inserts 33 are removed from the sideforms 17. Being of an elastomeric material, the inserts 33 can easily be detached from the sideforms 17. The sideforms 17 and corner forms 18 can then be pushed out of the opening 13 for re-use.

It is an advantage of the present invention that an improved false formwork system is provided which enables concrete panels, having window/door openings formed therein, to be cast one on top of the other in an extremely simple and cost effective manner and with minimal, if any, formwork imprints being left on the cast face of the upper panel. It is another advantage of the invention that an improved false formwork system for use in casting a concrete panel, having a window/door opening formed therein, is provided which can be installed easily without requiring skilled labour and which is re-useable thereby improving the cost effectiveness of the false formwork system.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of casting a concrete panel, the method including erecting a plurality of sideforms on a base to define an outer periphery of a panel to be cast; erecting false formwork within the sideforms to define an opening in the panel to be cast; demarcating at least a portion of a periphery of the opening; mounting infill in the false formwork so that the infill lies at a level lower than a surface of the panel to be cast; pouring concrete into the sideforms so that the concrete overlies the infill to define a false skim coat over the opening; and allowing the concrete to set to provide an uninterrupted upper surface of the panel.

2. The method of claim 1 which includes demarcating the at least portion of the periphery of the opening by forming a line of weakness in the cast concrete from below the upper surface of the panel.

3. The method of claim 1 which includes casting a further panel on the panel previously cast in substantially the same manner as the panel previously cast and using the previously cast panel as the base for the further panel to be cast.

4. The method of claim 1 which includes, once the concrete has been finished and allowed to set, removing the sideforms, raising the panel and removing the infill.

5. The method of claim 4 which includes breaking away the false skim coat along the demarcated periphery of the opening.

6. The method of claim 5 which includes removing the false formwork for re-use.

7. The method of claim 1 wherein the false formwork system includes a plurality of sideforms which are able to be interconnected to define a perimeter of an opening in a panel to be cast;

a support structure carried by the sideforms for supporting components used to mould a false skim coat overlying the opening when the panel is cast; and an opening demarcation portion carried by each of at least some of the sideforms, each opening demarcation portion defining a zone of weakness to demarcate the skim coat of the cast panel from a remainder of the panel and to facilitate removal of the skim coat from the remainder of the panel by breakage along the zone of weakness.

* * * * *